United States Patent [19]

Stuart

[11] Patent Number: 4,899,779

[45] Date of Patent: Feb. 13, 1990

[54] OIL RESERVOIR ASSEMBLY FOR FUSING APPARATUS

[75] Inventor: Paul O. Stuart, Pittsford, N.Y.

[73] Assignee: Eastman Kodak Company, Rochester, N.Y.

[21] Appl. No.: 336,390

[22] Filed: Apr. 11, 1989

[51] Int. Cl.[4] ..... B67D 5/00

[52] U.S. Cl. ..... 137/269; 137/571

[58] Field of Search ..... 137/269, 271, 571; 285/177

[56] References Cited

U.S. PATENT DOCUMENTS

| | | | |
|---|---|---|---|
| 2,401,367 | 6/1946 | Nagel | 285/177 |
| 2,490,149 | 12/1949 | Mosher | 285/177 |
| 3,169,562 | 2/1965 | Gogel | 285/177 |

*Primary Examiner*—Alan Cohan

*Attorney, Agent, or Firm*—Leonard W. Treash

[57] ABSTRACT

An oil reservoir for a fuser can be selectively assembled to accept either of two sources of oil and reject the other source. The reservoir has two different openings. An intermediate member has alternative coupling means to fit either opening. The intermediate member accepts a different source of oil depending upon which opening it is coupled to and reject the other source.

3 Claims, 2 Drawing Sheets

OIL RESERVOIR ASSEMBLY FOR FUSING APPARATUS

TECHNICAL FIELD

This invention relates to an oil reservoir assembly for a fusing apparatus of the type requiring the application of a release liquid.

BACKGROUND OF THE INVENTION

For nearly three decades the fusing mechanism of choice for fixing toner images to paper or other surfaces has been a pair of pressure rollers. Generally, at least one of the rollers is heated and contacts the toner image to fuse it. A release liquid commonly called "fusing oil" is applied to the surface of one or both of the rollers to prevent the offset of toner onto the roller. The oil is commonly held in a reservoir from which it is pumped to a wick or other applicating mechanism. The oil in the reservoir must be replaced periodically.

A large variety of fusing oils are presently used in the industry. They vary both according to fusing application, for example, the temperature at which used, but more importantly according to their usefulness with the specific surface at which they are applied. Obviously, it is undesirable to have the wrong fusing oil in a particular apparatus. In addition to not working as well under the conditions of that fuser, it may also cause early replacement of an expensive roller.

The problem is especially serious when similar apparatus manufactured by a single manufacturer uses two different fusers requiring two different oils. For example, a black only version of an electrophotographic copier may use a particular fusing material requiring a particular oil and a more sophisticated color version of the same copier may require a different fuser utilizing a different oil. Getting the right oil for the right apparatus in this situation cannot be left entirely to directions on a package.

This problem can be approached by designing a separate oil bottle-reservoir system for each of the models. However, that requires tooling and manufacture of a separate reservoir for each of the models.

SUMMARY OF THE INVENTION

It is the object of the invention to provide a reservoir assembly for fusing oils generally of the type described but which can be set up to reject either of two oil sources and admit the other without a difference in parts between the two applications.

This and other objects are accomplished by a reservoir assembly having a reservoir means with two openings, each opening having an opening coupling means associated with it. The coupling means differ in at least one characteristic. For example, the openings can be of different diameter and the coupling means for each can be screw threads determined by that diameter. An intermediate coupling member has two intermediate coupling means, one for coupling with one opening coupling means and the other for coupling with the other opening coupling means.

To set the reservoir assembly up for receiving one type of oil the intermediate coupling means is coupled to the coupling means associated with the first opening leaving the intermediate coupling means that would ordinarily be associated with the second opening free to receive a source of oil. That source of oil is a bottle or other container which can be coupled with a portion of the intermediate coupling means that would couple with the second coupling means.

To set the reservoir assembly up to take a second type of oil the intermediate coupling means is coupled to the opening coupling means associated with the second opening leaving the first intermediate coupling means available to receive an oil container having a different characteristic, that is, one for coupling with the first intermediate coupling means.

Since the first intermediate coupling means will not receive a bottle designed for the second intermediate coupling means and vice versa, the reservoir can be made to accept one source of oil and reject the other depending on which opening is connected to the intermediate member.

According to a preferred embodiment, the openings have threaded flanges and are of different size. The intermediate member is a collar having an internal bore with two portions, one portion having threads which would mate with the threads of the larger opening and the other having threads which would mate with the threads of the smaller opening. The larger opening mates with the larger portion of the collar leaving the smaller portion for receiving a small neck fusing oil bottle. When the smaller opening is used the smaller portion of the collar mates with it leaving the larger portion of the intermediate member to receive a large necked fusing oil bottle. The unused opening is not totally capped but is used in each instance as the opening out of which the oil is pumped.

Thus, a reservoir assembly is provided which rejects the wrong oil but uses common parts for each type of apparatus. Only assembly varies.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
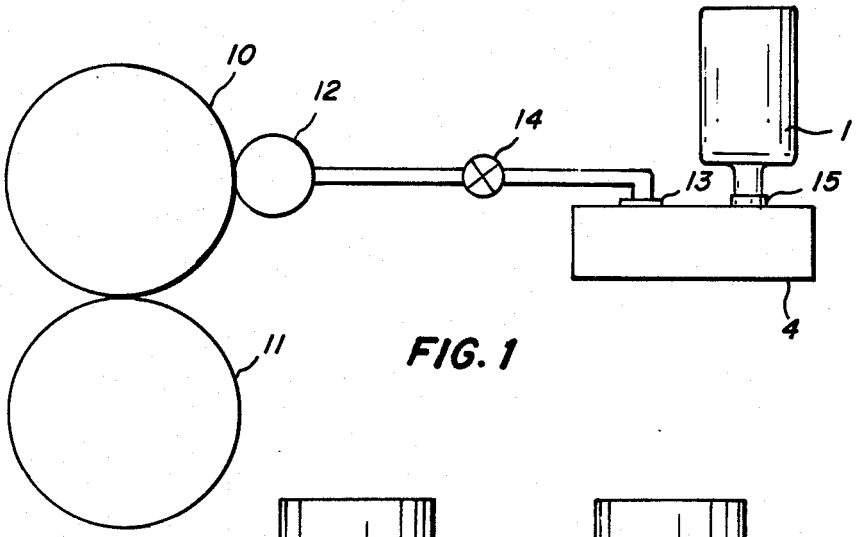
FIG. 1 is a schematic side view of a fusing apparatus with which the invention is useable.

According to FIG. 1 a roller fuser with which the invention can be used includes a fusing roller 10 and a pressure roller 11 which form a nip in between which a sheet of paper or other material carrying a toner image is fed. To prevent offset of toner onto the fusing roller 10 a thin layer of silicone oil or other release liquid is applied to it by a rotating wick 12 which is fed internally with oil by a pump 14. The pump 14 pumps oil from a reservoir assembly 4 through an opening 13. Another opening 15 is used to supply oil from a source 1 of oil when oil is depleted from the reservoir 4

A single manufacturer may have two similar apparatus but with different fusers. For example, the surface of fusing roller 10 may be of one material in one model and a different material in another model for handling different types of toners. These different models from the same manufacturer may require a different fusing oil. According to the invention, a different bottle-reservoir combination can be used for either of two oils with each combination rejecting the wrong bottle, but without different reservoir parts.

Figure 2:
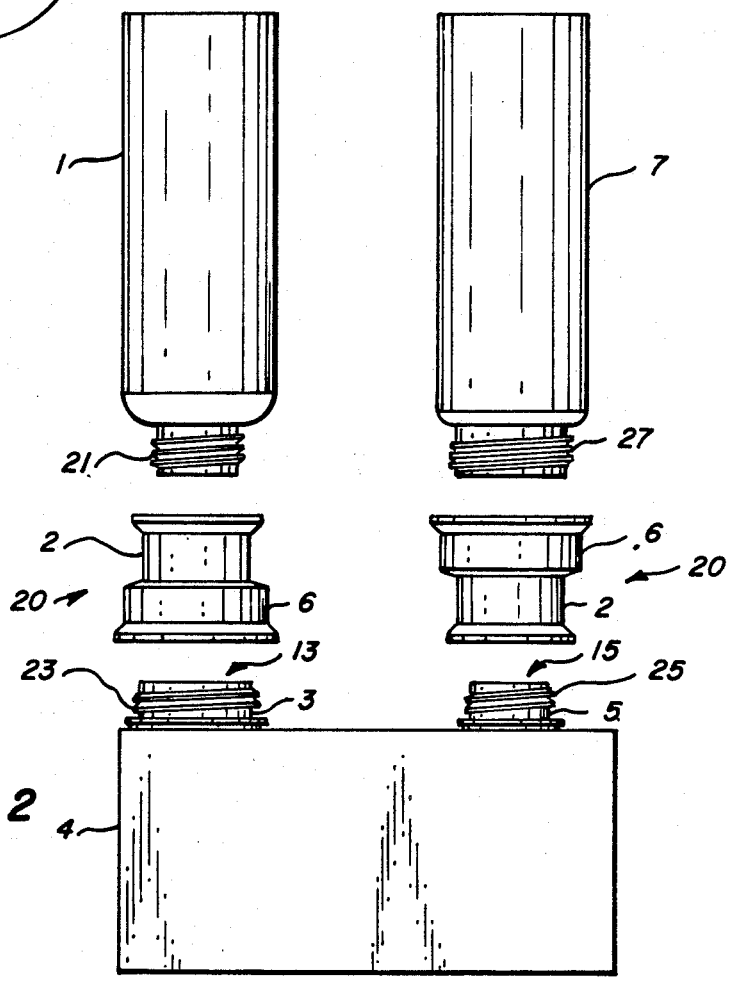
FIG. 2 is a schematic side view partially exploded of a reservoir and alternative oil supplying bottles therefor.

According to FIG. 2, a reservoir assembly includes reservoir means 4 for holding fusing oil and an intermediate member 20. Reservoir means 4 has a first large opening 13 and a second small opening 15. The large opening 13 has a first opening coupling means, for example, a large cylindrical member 3 with large diameter external screw threads 23 while smaller opening 15 has a second opening coupling means, for example, a small cylindrical member 5 with small diameter external screw threads 25.

Intermediate member 20 is shown twice in FIG. 2 to illustrate its ability to cooperate with either opening 13 or 15. In actual use it would only be used with one of the openings. Intermediate member 20 has first and second intermediate coupling means, each mateable with a different one of the opening coupling means. For example, intermediate member 20 can be a collar having different sized portions 2 and 6. Portion 2 has a small diameter internal screw threads which are couplable with the small diameter external screw threads 25 associated with opening 15. The larger portion 6 has large diameter internal screw threads which are couplable with the large diameter screw threads 23 associated with opening 13.

In operation, oil of one kind is supplied in a bottle 1 with a small neck 21 including screw threads that will cooperate with the smaller portion 2 of intermediate member 20. The other oil is supplied in a bottle 7 having a large neck 27 with external screw thread cooperable with larger portion 6. For a first type of apparatus using an oil of the type supplied in bottle 1, the reservoir is assembled for use in a first mode. Intermediate member 20 is permanently screwed onto the coupling means 3 and 13 surrounding opening 13 using the larger portion 6. This leaves the smaller portion number 2 which can receive the bottle 1 with the small neck 21.

If the apparatus is adapted to use the type of oil supplied in bottle 7, the reservoir is assembled for use in a second mode. Intermediate member 20 is applied to the smaller opening 15 by mating the smaller portion 2 with the coupling means 5 and 25 associated with that opening. This leaves the larger portion 6 for receiving the wide neck 27 of bottle 7.

The same parts, reservoir means 4 and intermediate member 20, can be used for setting up either type of apparatus for receiving the appropriate bottle. The only difference is in assembly.

Although the drawings show external threads 23 and 25 on the coupling means associated with openings 13 and 15 those coupling means could be internal threads with the intermediate member having external threads and the bottle internal threads. Because of a preference for external threads on the bottles, this is an inferior approach. Similarly, the openings could be of the same size but the coupling means may differ in some other respect; for example, the pitch of the screw threads could be made different. Although such an approach is within the scope of the invention, it is an inferior approach to having the openings of different size because the tendency to try to force the incorrect bottle would be increased if the difference in size is missing.

The invention has been described in detail with particular reference to a preferred embodiment thereof, but it will be understood that variations and modifications can be effected within the spirit and scope of the invention as described hereinabove and as defined in the appended claims.

I claim:

1. A reservoir assembly for use in a liquid supply system for apparatus for fusing toner images, said reservoir assembly being designed to hold only one of two different liquids, said reservoir assembly comprising:

reservoir means for holding liquid, said reservoir means having first and second openings, an intermediate coupling member having first and second opposed intermediate coupling means;

first and second opening coupling means associated with said first and second openings, respectively, said first opening coupling means being couplable with said first intermediate coupling means and said second opening coupling means being couplable with said second intermediate coupling means, but said first opening coupling means being not couplable with said second intermediate coupling means and said second opening coupling means being not couplable with said first intermediate coupling means.

said intermediate coupling member having alternative first and second modes of use, wherein in said first mode said first intermediate coupling means is coupled with said first opening coupling means and said second intermediate coupling means is couplable with a source of oil which has a source coupling means comparable to said second opening coupling means, and in said second mode said second intermediate coupling means is coupled to said second opening coupling means and said first intermediate coupling means is couplable with a source of oil having a source coupling means comparable to said first opening coupling means.

2. A reservoir assembly for use in a supply system in apparatus for fusing toner images, said reservoir assembly being designed to hold only one of two different liquids, said reservoir assembly comprising:

housing means for holding liquid, said housing means having a wide opening and a narrow opening;

wide coupling means associated with said wide opening and narrow coupling means associated with said narrow opening, an intermediate coupling member having wide and narrow intermediate coupling means couplable with said wide and narrow opening coupling means respectively, said intermediate coupling member having first and second modes of use in which in said first mode said narrow intermedite coupling means is coupled to said narrow opening coupling means and said wide intermediate coupling means is thereby positioned to receive a source of oil having a wide coupling means compatible with it, and in said second mode said wide intermediate coupling means is coupled to said wide opening coupling means leaving said narrow intermediate coupling means positioned to receive a source of oil having a narrow coupling means compatible with it.

3. A reservoir assembly according to claim 2 wherein said intermediate coupling means is a collar having an internal bore and said intermediate coupling means are screw threads on the internal bore.

* * * * *